US007494182B2

(12) United States Patent
Westendorf et al.

(10) Patent No.: US 7,494,182 B2
(45) Date of Patent: Feb. 24, 2009

(54) ACCESS AND SUPPORT SYSTEM FOR CONVERTIBLE FURNITURE

(75) Inventors: David J Westendorf, Monroe, MI (US); Kevin J Knowles, Monroe, MI (US)

(73) Assignee: West & Knowles Design & Engineering, L.L.C., Monroe, MI (US)

( * ) Notice: Subject to any disclaimer, the term of this patent is extended or adjusted under 35 U.S.C. 154(b) by 577 days.

(21) Appl. No.: 11/103,404

(22) Filed: Apr. 11, 2005

(65) Prior Publication Data

US 2006/0249998 A1 Nov. 9, 2006

(51) Int. Cl.
*A47C 3/025* (2006.01)

(52) U.S. Cl. ..... 297/284.2; 297/452.63; 297/188.1

(58) Field of Classification Search ..... 297/284.2, 297/452.63, 331, 335, 188.1
See application file for complete search history.

(56) References Cited

U.S. PATENT DOCUMENTS

| | | | | |
|---|---|---|---|---|
| 984,685 | A | | 2/1911 | Luppino |
| 1,244,821 | A | | 10/1917 | Zaleski et al. |
| 1,398,324 | A | | 11/1921 | Hosner |
| 1,751,897 | A | | 3/1930 | Thum |
| 1,824,156 | A | | 9/1931 | Kimble |
| 2,033,795 | A | | 3/1936 | Ward, Jr. |
| 2,648,072 | A | | 8/1953 | DeBlieux |
| 2,907,378 | A | * | 10/1959 | Barecki ..... 297/188.1 |
| 3,399,883 | A | * | 9/1968 | McKey ..... 267/89 |
| 4,153,958 | A | | 5/1979 | Paulik |
| 4,169,295 | A | | 10/1979 | Darling |
| 4,227,268 | A | | 10/1980 | Gerth |
| 4,366,585 | A | | 1/1983 | Ponti et al. |
| 4,442,556 | A | | 4/1984 | Craigie |
| 4,538,308 | A | | 9/1985 | Grigoriev |
| 4,541,133 | A | | 9/1985 | Reiss et al. |
| 4,625,345 | A | | 12/1986 | Wood |
| 4,694,515 | A | | 9/1987 | Rogers, Jr. |
| 4,875,244 | A | | 10/1989 | Tremblay |
| 5,129,113 | A | | 7/1992 | Sherman |
| 5,303,976 | A | | 4/1994 | Nobile et al. |
| 5,314,234 | A | | 5/1994 | England |
| 5,315,726 | A | | 5/1994 | Borenstein |
| 5,329,654 | A | | 7/1994 | Sherman |
| 5,385,389 | A | * | 1/1995 | Bishai ..... 297/339 |
| 5,584,530 | A | | 12/1996 | Rogers et al. |
| 5,794,283 | A | | 8/1998 | Vila et al. |

(Continued)

OTHER PUBLICATIONS

Leggett & Platt Company, "Sinuweb Hybrid Suspension System, Improved Seating Concepts", 1 pg, undated.

(Continued)

*Primary Examiner*—Laurie K Cranmer
(74) *Attorney, Agent, or Firm*—Harness, Dickey & Pierce, P.L.C.

(57) ABSTRACT

A furniture seating support system includes furniture support structure and a frame having tubular elements connected to the support structure. First and second tubular elements are positioned parallel to each other. A tubular cross member is connected to the frame between the first and second elements. A pair of pivoting joints each connect first element ends to the support structure, permitting first element rotation. Elastically flexible support straps with elastomeric elements are connected to the first and second elements to support an occupant. The cross member position is adjustable to vary strap stiffness. A furniture member cavity is accessible by raising the first element.

43 Claims, 9 Drawing Sheets

U.S. PATENT DOCUMENTS

| | | | | |
|---|---|---|---|---|
| 5,884,977 | A * | 3/1999 | Swamy et al. | 297/452.52 |
| 6,082,825 | A * | 7/2000 | Simon | 297/452.63 |
| 6,616,229 | B2 * | 9/2003 | Kuster et al. | 297/284.9 |
| 6,691,342 | B2 | 2/2004 | Sherman | |
| 6,929,321 | B1 * | 8/2005 | Shrock | 297/118 |

OTHER PUBLICATIONS

Matrex, "Innovative Solutions, Consistent Performance, and Impeccable Service", 2 pgs, undated.
Matrex, "Improved Seating Concepts", 6 pgs, Jan. 10, 2005.

* cited by examiner

FIG 3
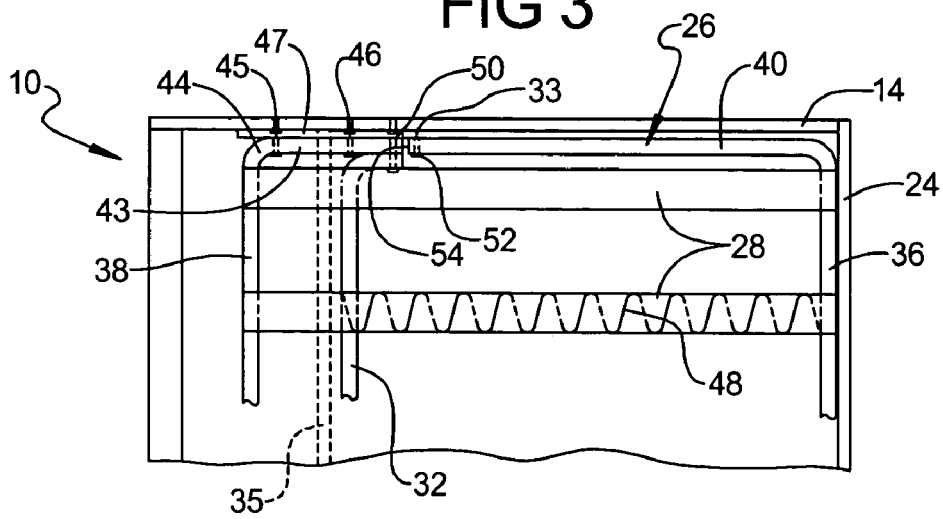
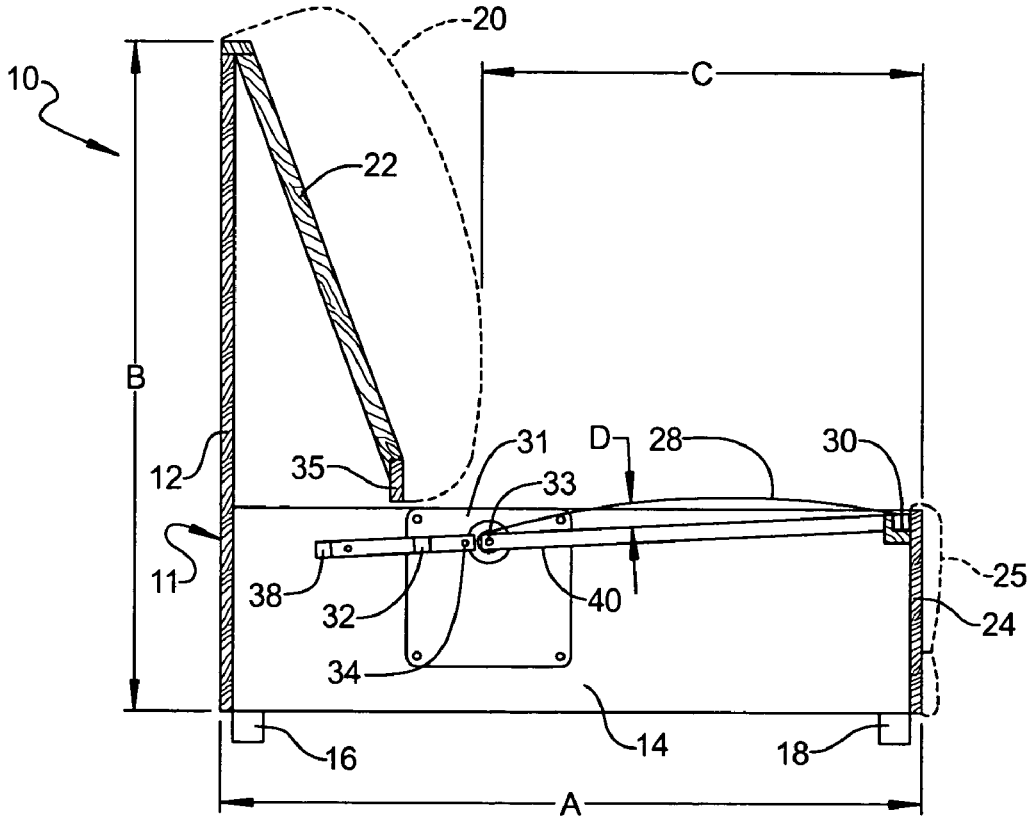
FIG 2

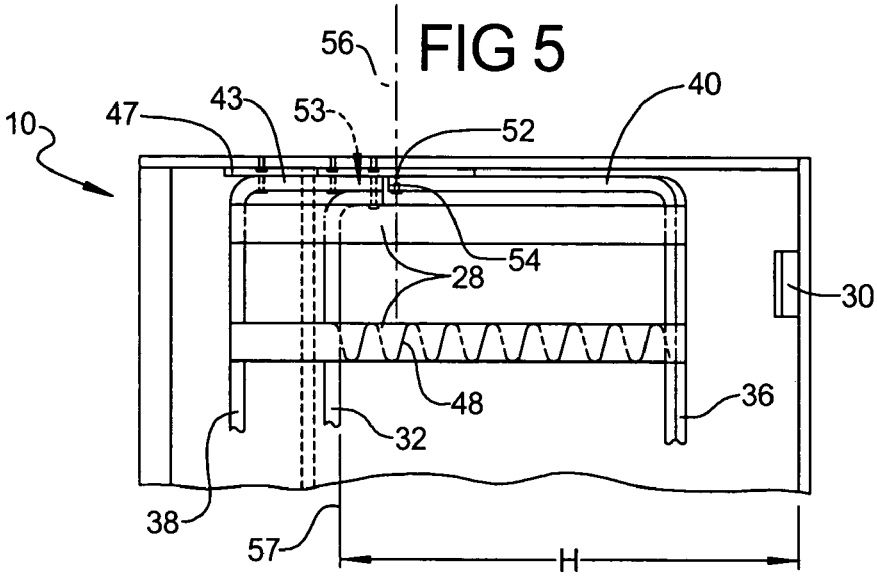
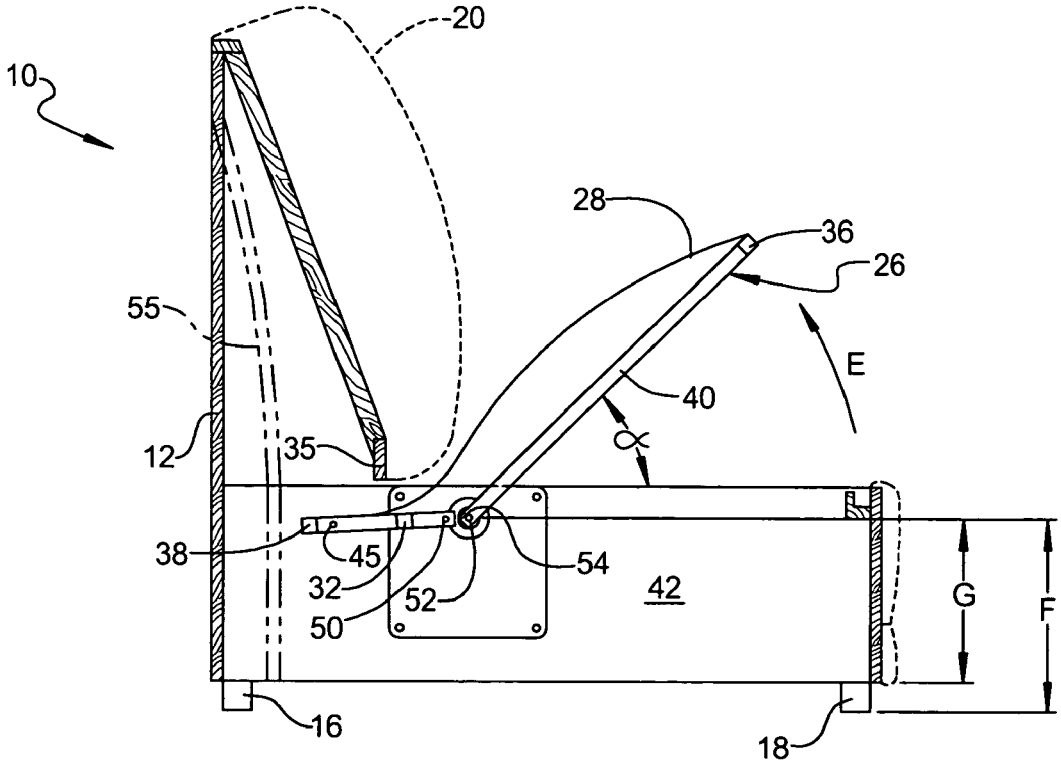
FIG 4

FIG 8
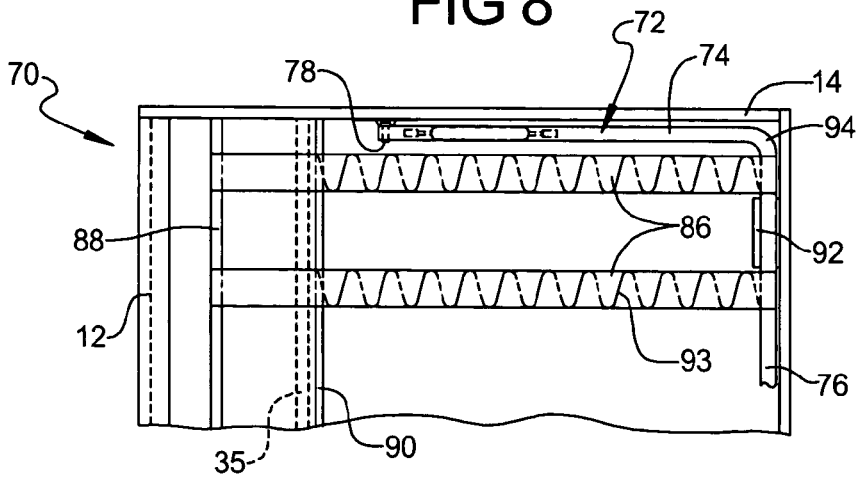
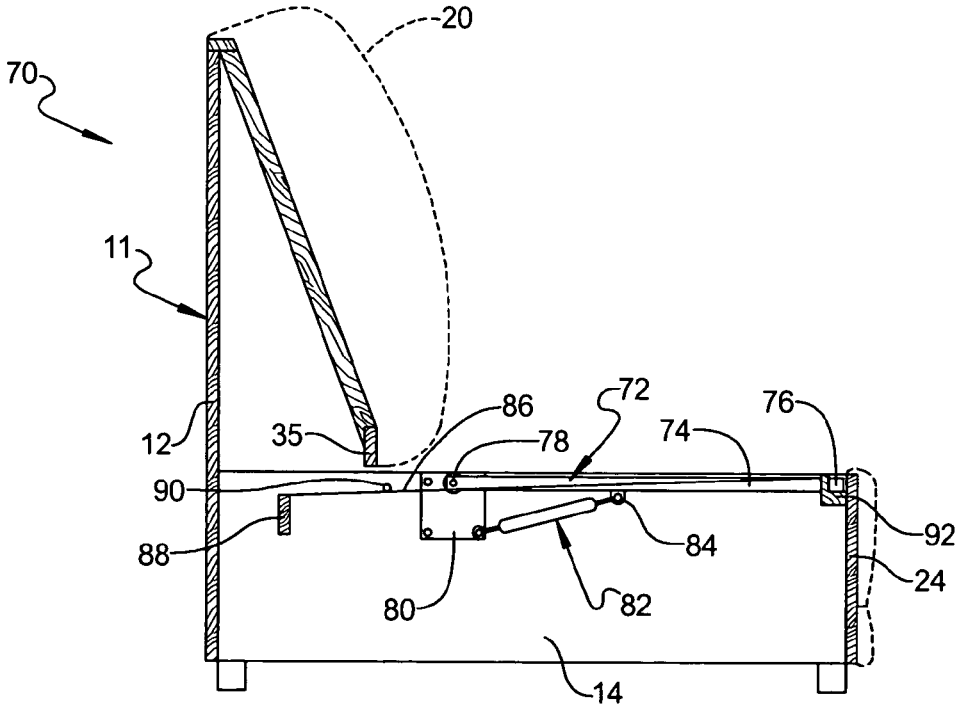
FIG 7

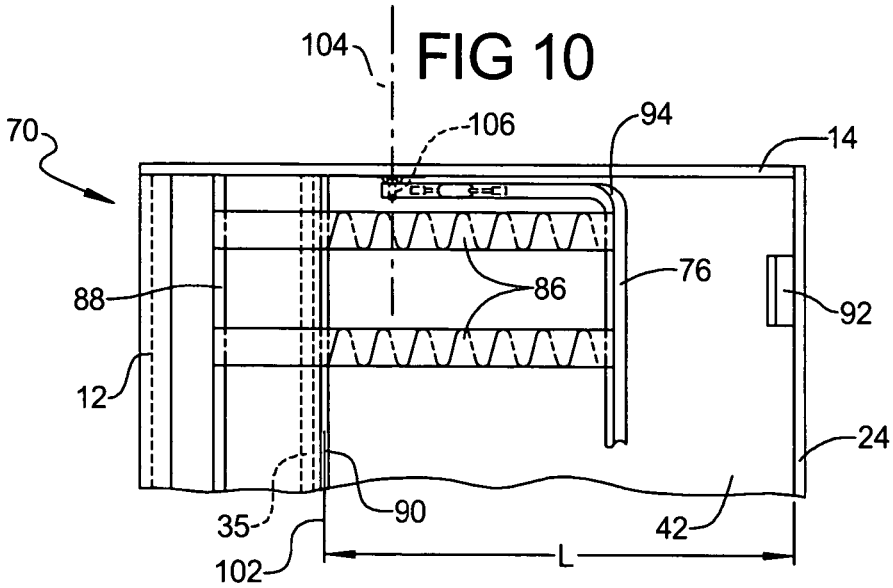
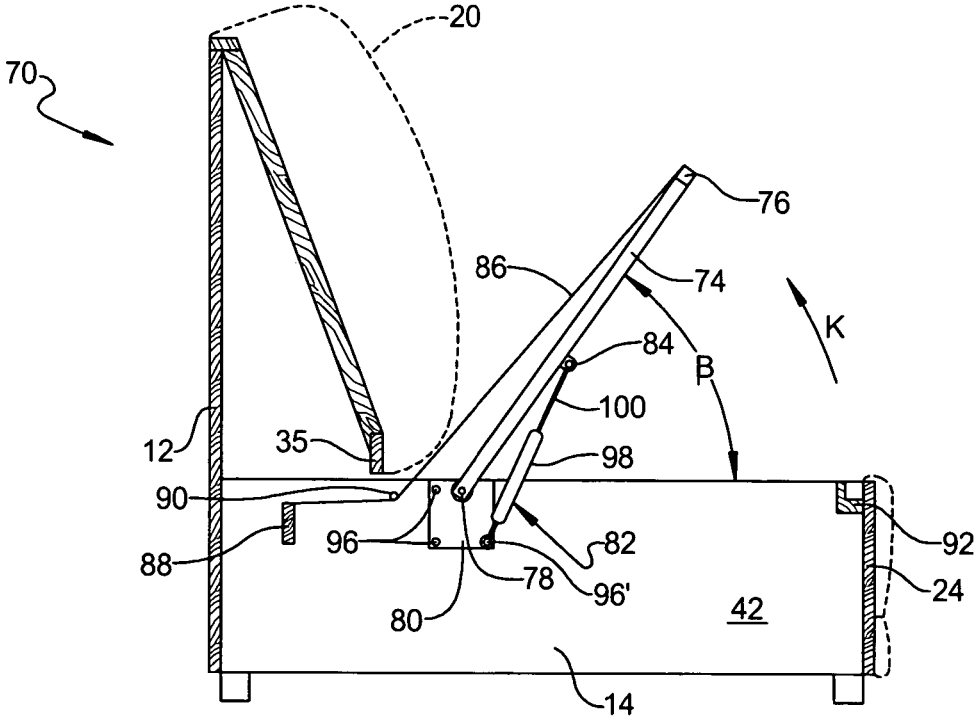
FIG 9

P
116
114
31
110
Q
112
M
114
118
116
110
N

ACCESS AND SUPPORT SYSTEM FOR CONVERTIBLE FURNITURE

FIELD OF THE INVENTION

The present invention relates in general to furniture members and more specifically to a device and method for converting furniture members for alternate uses.

BACKGROUND OF THE INVENTION

Convertible furniture members include sofas, reclining chairs, sleep sofas, interchangeable sectional furniture, and the like. Convertible furniture members can also include pull-out underneath storage devices. For purposes of simplicity, sofas, including sleep sofas will be herein described in reference to typical hardware packaging. Hardware to convert a sleep sofa unit for alternate (extended mattress) use is often a complex mechanism, having multiple linkages, multiple fasteners, and extensive, heavy tubing or structure. The typical mechanism set for a sleep sofa extends outwardly from an interior sofa storage section to the full length of the mattress. The mechanism volume can occupy a substantial portion of the below-seat-cushion space of the sleep sofa, leaving a decreased volume for the mattress or other uses.

The volume of mechanism hardware to be stored when the mattress is not in use generally also commonly requires a sleep sofa to have a vertical rear panel rather than the more conventional styling of a curved or sloped rear panel of non-convertible or stationary sofas. The vertical rear panel is less attractive and can interfere with use of items such as electrical plugs positioned behind the sleep sofa.

Conventional stationary sofas, although not having the mechanism of a sleep sofa, commonly have cushion support members and framework that supports the sofa cushions. Although sofa cushions are commonly removable for cleaning, the support members and framework positioned below the sofa cushions are commonly not intended to permit access to the space below the sofa cushions. This space is typically inaccessible and therefore goes unused by the sofa owner.

SUMMARY OF THE INVENTION

According to a preferred embodiment for an access and support system for convertible furniture of the present invention, a furniture seating support system includes furniture support structure and a frame having tubular elements connected to the support structure. First and second tubular elements are positioned parallel to each other. A tubular cross member is connected to the frame between the first and second elements. A pair of pivot joints each connect first element ends to the support structure, permitting first element rotation. Elastically flexible support straps are connected to the first and second elements to support seating cushions and an occupant. A furniture member cavity is accessible by raising the first element.

According to another preferred embodiment, the cross member position is adjustable to vary strap stiffness. A plurality of apertures are provided in the support frame and fasteners are inserted through the cross member and selected ones of the apertures to vary a span between the furniture support structure and the cross member.

According to still another preferred embodiment, sinuous wire springs are interwoven with each of the support straps. The sinuous wires are located between the furniture support structure and the cross member. The sinuous wires provide additional stiffness for the straps and also provide a resilient force which helps maintain the support frame in the raised position.

According to yet still another preferred embodiment, a method for creating a rotatable support frame for a furniture member is provided. The method includes a step of adjustably positioning a cross member between first and second tubular elements to control a stiffness of the support straps. The method further includes rotating the first element about pivoting joints to permit access to a furniture member cavity by a user.

An access and support system for convertible furniture of the present invention offers several advantages. A rotatable support frame positioned below the seating area is rotatable to permit access to the space below the seating area. Seating support straps are connectable across spaced tubular members of the support frame. An adjustable frame cross member is located proximate to the support bands to provide a variable support point which allows varying the seating support stiffness. By optionally providing sinuous wire support members interwoven with the seating support straps, which extend for only a portion of the length of the seating support straps, the resiliency of the sinuous wires helps support the support frame in a rotated or open position. The reduced complexity and volume of the support frame of the present invention also permits the sofa rear frame to be curved inwardly, without interfering with the operation of the mechanism.

The features, functions, and advantages can be achieved independently in various embodiments of the present inventions or may be combined in yet other embodiments.

BRIEF DESCRIPTION OF THE DRAWINGS

The present invention will become more fully understood from the detailed description and the accompanying drawings, wherein:

FIG. 2 is a cross sectional elevational view taken at section 2 of FIG. 1.

FIG. 3 is a plan view of the sofa portion of FIG. 2;

FIG. 4 is a cross sectional elevational view similar to FIG. 2, showing the sofa frame in a rotated position;

FIG. 5 is a plan view of the sofa portion of FIG. 4;

FIG. 7 is a cross sectional elevational view similar to FIG. 2 of an alternate embodiment of an access and support system for convertible furniture of the present invention;

FIG. 8 is a plan view of the sofa portion of FIG. 7;

FIG. 9 is a cross sectional elevational view similar to FIG. 7, showing the alternate embodiment sofa frame in a rotated position;

FIG. 10 is a plan view of the sofa portion of FIG. 9;

DETAILED DESCRIPTION OF THE PREFERRED EMBODIMENTS

The following description of the preferred embodiments is merely exemplary in nature and is in no way intended to limit the invention, its application, or uses.

Figure 1:
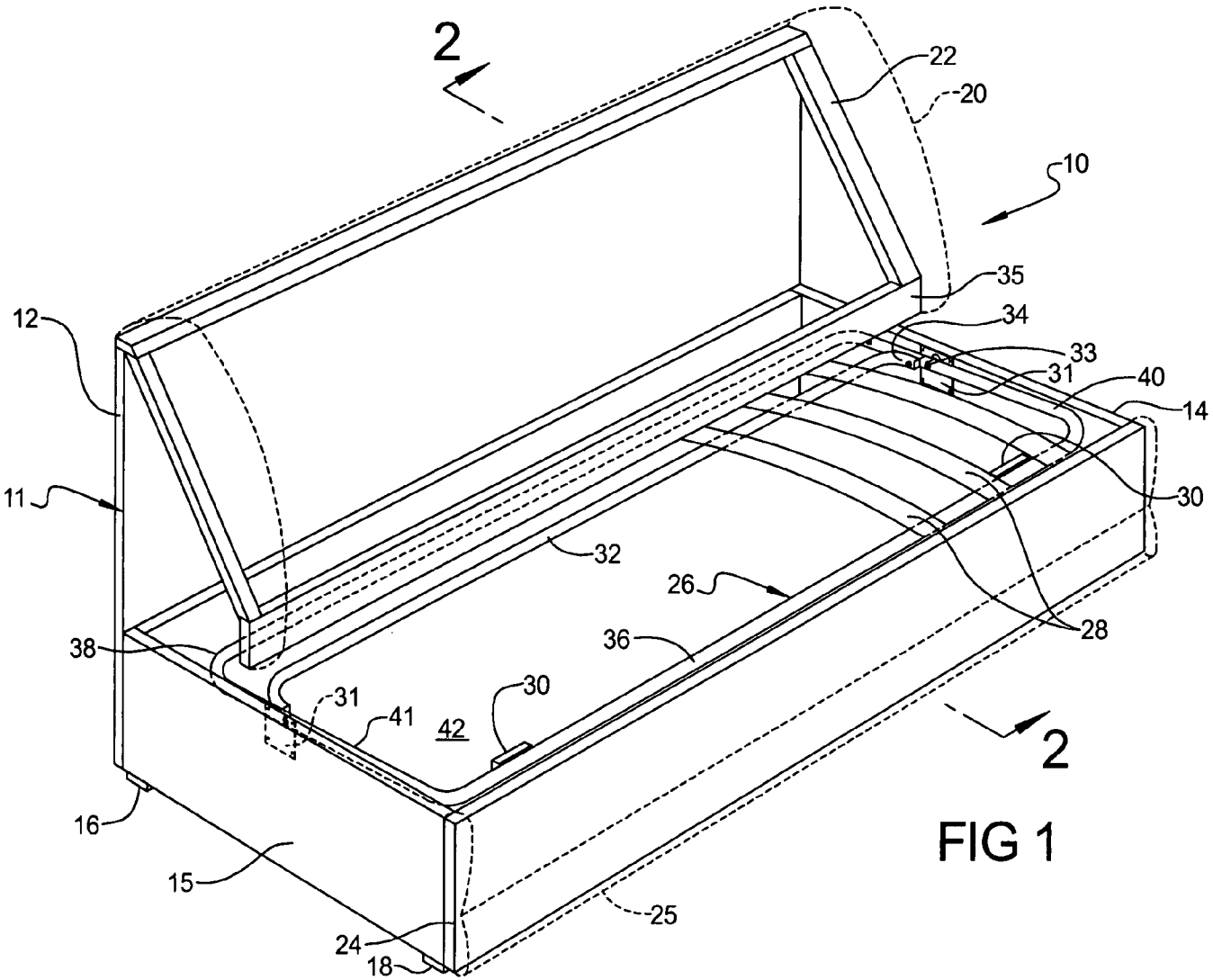
FIG. 1 is a front perspective view of a sofa frame incorporating an access and support system for convertible furniture of the present invention.

According to a preferred embodiment of an access and support system for convertible furniture of the present invention and referring generally to FIG. 1, a furniture support system 10 includes a support structure 11 having a rear frame member 12 and each of a first side frame member 14 and a second side frame member 15. A rear support leg 16 and a front support leg 18 are exemplary of support legs provided at least at each of the outer corners of support structure 11. Support structure 11 provides support for a lumbar support cushion 20 (shown in phantom for clarity) which is connected to a cushion support frame 22 extending forwardly from rear frame member 12. A front frame member 24 joins forward edges of each of first and second side frame members 14, 15. Front frame member 24 is commonly provided with an upholstered front cushion 25. The terms "front" and "rear" as used herein refer to the front or user accessible side of a sofa type furniture member and rear refers to the back or wall facing side of the furniture member. These terms are not intended to limit the invention or its application to other furniture member designs.

A support frame 26 is created from a plurality of substantially rectangular or circular shaped metallic tubing and is operable to support a plurality of occupant support webs or straps 28. Other shapes such as L-channel, U-shaped channel, T or H-shaped channel, etc. can also be used for support frame 26. Alternate materials can also be used for support frame 26 such as polymeric material or composite material. Support straps 28 are provided of a material such as a woven polymeric material, a woven cloth material, or a composite material, and preferably provides at least a limited amount of elastic flexibility. Support frame 26 is partially supported to front frame member 24 using at least one bracket 30. In one embodiment, two brackets 30 connected to front frame member 24 are used.

According to one embodiment, support frame 26 is also partially supported using a plurality of side rail brackets 31 each connected to one of first and second side frame members 14, 15. Side rail brackets 31 provide for pivotal support of a portion of support frame 26. A support frame cross member 32 is fixedly connected to support frame 26 at distal ends of cross member 32 using each of a plurality of fixed joints 34. In one embodiment, cross member 32 is positioned generally below each of support straps 28 as shown in FIG. 1 and is adjustable to control the stiffness of support straps 28 and thereby carry some of the support load from an occupant. Cross member 32 is positioned proximate to a frame lumbar support member 35 which extends from a distal end of cushion support frame 22.

Support frame 26 further includes a first tube member 36 which in the embodiment shown is positioned as a forwardmost tube member of support frame 26. A second tube member 38 is positioned substantially parallel to and to the rear of first tube member 36. Second tube member 38 is also positioned to the left or rear of frame lumbar support member 35. Each of first tube member 36, second tube member 38 and cross member 32 are positioned substantially parallel to each other. First tube member 36 is shown in FIG. 1 in a first position, acting as a seating support or down position supported by brackets 30. First tube member 36 is rotatably repositionable from the first position by rotation about each of the pivoting joints 33.

Each of the plurality of support straps 28 are connected to both first and second tube members 36, 38. When support frame 26 is in the first or support position shown, access to a cavity 42 is substantially prevented by support straps 28. Because support frame 26 occupies only a fraction of cavity 42, however, when first tube member 36 is rotated, access is provided to a substantial portion of cavity 42. Cavity 42 is generally defined as the available volume created between the various members of support structure 11.

Referring now to FIG. 2, support structure 11 includes a front-to-back or width dimension "A", a total height "B", and an available seating space "C" between front frame member 24 and lumbar support cushion 20. Brackets 30 define a substantially U-shaped cavity when connected to front frame member 24 which receives first tube member 36 in the first or closed position. First tube member 36 also includes both a first and second end 40, 41 each oriented substantially parallel to first and second side frame members 14, 15. Pivoting joints 33 are created in each of first and second ends 40, 41.

In one preferred embodiment of the present invention, each of the support straps 28 curve upwardly from each of first and second ends 40, 41 to a maximum arc height "D". In this configuration, arc height "D" allows deflection of support straps 28 without the weight of the occupant causing support straps 28 to extend significantly below first or second ends 40, 41. This maximizes the usable volume of cavity 42. The curvature or arc provided for support straps 28 generally extends from first tube member 36 to approximately cross member 32. The configuration of support straps 28 is thereafter substantially flat between cross member 32 and second tube member 38 in the first or down position.

Referring now to FIG. 3, second tube member 38 includes opposed ends 43 (only one of which is visible in FIG. 3) each joined to second tube member 38 using a tube bend 44. Each opposed end 43 is connectably joined to one of first or second side frame members 14, 15 using a first and second fastener 45, 46 which non-rotationally couples second tube member 38 to support structure 11. A spacer block 47 can also be positioned between each opposed end 43 and either first or second side frame member 14, 15.

Each of the support straps 28 have an elastomeric element 48 coupled to or interwoven in an over/under fashion to support straps 28. According to one preferred embodiment, elastomeric elements 48 are sinuous wires. Elastomeric elements 48 can also be a plurality of coiled wires. In another preferred embodiment, support straps 28 are completely replaced by elastomeric elements 48 in the form of sinuous wires. A total length of the elastomeric elements 48 is predetermined and according to one preferred embodiment each elastomeric element 48 extends from proximate to first tube member 36 to a position proximate to cross member 32. Distal ends of each of the elastomeric elements 48 are therefore substantially supported by first tube member 36 and cross member 32. In another preferred embodiment, the length of elastomeric elements 48 in the form of sinuous wires is reduced such that each sinuous wire is positioned only between but not supported by either first tube member 36 or cross member 32.

As further shown in reference to FIG. 3, a third fastener 50 is disposed through each of an opposed pair of distally extending ends of cross member 32, through one of the opposed ends 43 and either first or second side frame member 14, 15. Cross member 32 is non-rotatably positioned using each of third fasteners 50. A fourth fastener 52 such as a rivet is used to create pivoting joints 33. Fourth fasteners 52 extend through each of first and second ends 40, 41 of first tube member 36 and through one of first or second side frame members 14, 15. In addition to the use of rivets, fourth fasteners 52 can also be bolts, stud bolts, etc. Fourth fasteners 52 are positioned proximate to a tube end 54 of each of first and second ends 40, 41 of first tube member 36. This provides clearance for rotation of first tube member 36. Frame lumbar support member 35 is shown in phantom in FIG. 3 for reference to the location of cross member 32. Cross member 32 is generally positioned towards front frame member 24 relative to frame lumbar support member 35 to prevent contact between any of the support straps 28 and/or elastomeric elements 48 with frame lumbar support member 35.

Referring next to FIG. 4, support frame 26 is shown in a second or raised position following rotation about a rotational arc "E". When rotated to the second position, an angle $\alpha$ is created between each of first and second ends 40, 41 in their second position compared to the first or seat support position of first and second ends 40,41. In one embodiment, angle $\beta$ is at least 45° to maximize accessibility to cavity 42, however other angles greater or less than 45° can be used. Cavity 42 has a minimum height "G" defined from an underside of first and second ends 40, 41 in their first position and an underside of each of first and second side frame members 14, 15. When rear and front support legs 16, 18 are used, cavity 42 is increased to a total height "F" provided by the additional length of rear and front support legs 16, 18.

In an alternate embodiment, a curved rear frame member 55 (shown in phantom) can be used for support structure 11 due to the limited volume required for support frame 26. Curved rear frame member 55 provides a more aesthetically pleasing appearance and is similar to the geometry commonly found on furniture members which are not convertible for other use.

As best seen in reference to FIG. 5, cross member 32 provides a support axis 57 for each of the plurality of support straps 28. The length of sinuous wires used for elastomeric elements 48 is nominally equal to a dimension "H" substantially equaling a distance from an inside face of front frame member 24 to support axis 57. In the second or rotated position, first tube member 36 is rotated clear of each of the brackets 30. Clearance to access cavity 42 is therefore provided substantially entirely between inside edges of front frame member 24 and both first and second side frame members 14, 15, which is impeded only by the limited volume occupied by brackets 30. By adjusting dimension "H", a support stiffness provided by support straps 28 and/or elastomeric elements 48 can be varied. For example, by reducing dimension "H" a stiffer support feel is provided, and by increasing dimension "H" a softer support feel is provided. Dimension "H" is generally predetermined by the furniture manufacturer. Dimension "H" is varied by varying a forward/rearward location of third fasteners 50. In one embodiment, this is accomplished by providing a plurality of apertures 53 (shown in phantom only) provided in each of opposed ends 43. Fourth fasteners 52 also define an axis of rotation 56 for first tube member 36.

Figure 6:
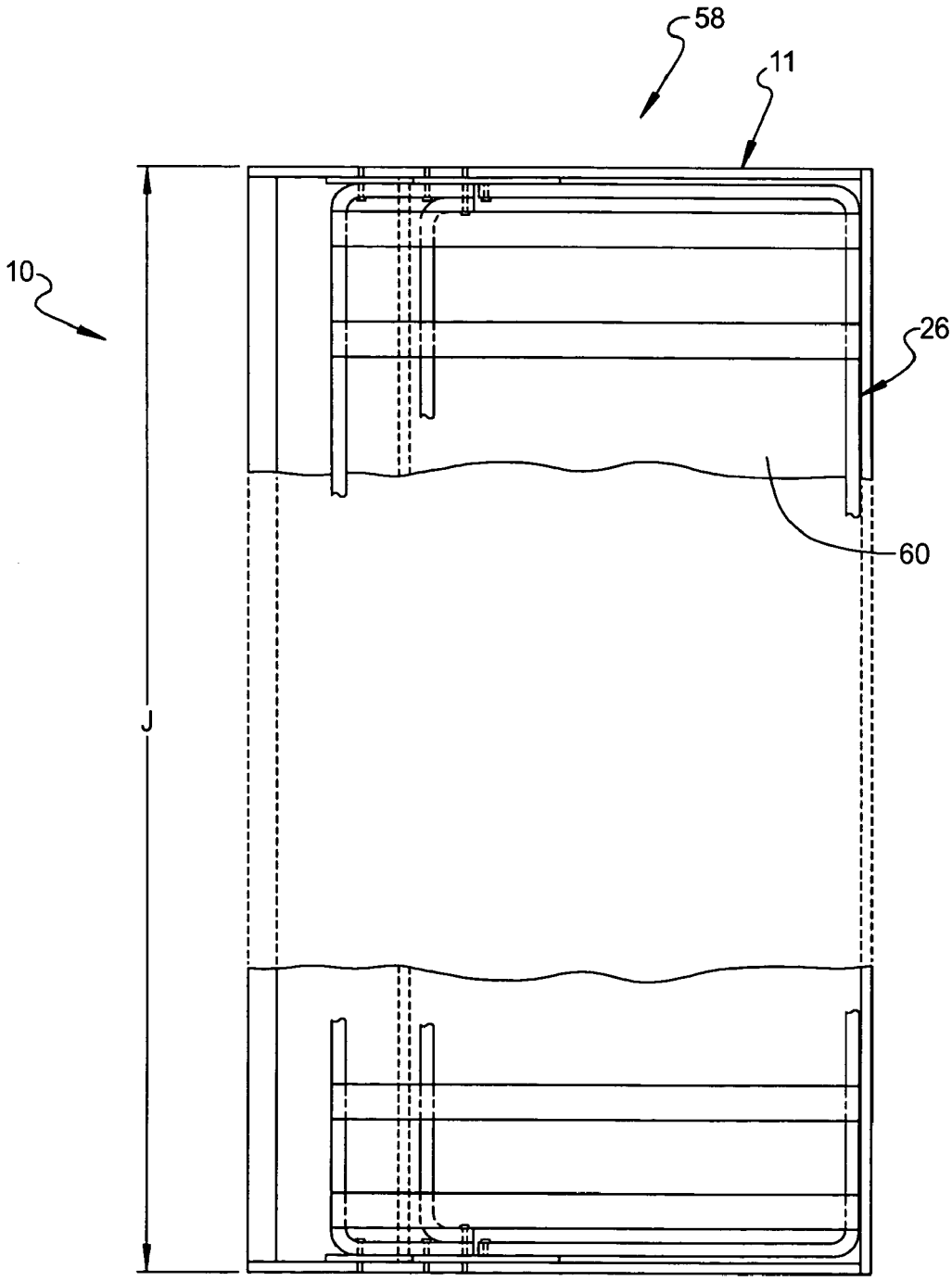
FIG. 6 is a plan view of the sofa frame of FIG. 1.

Referring now generally to FIG. 6, an overall assembly of furniture support system 10 for a furniture member 58 includes an overall width "J". Width "J" is variable for a variety of different furniture members including but not limited to sofas, sleep sofas, love seats and individual chairs. Furniture support system 10 is therefore applicable to a variety of furniture member designs and is also not limited to fixed or stationary furniture members. For example, furniture support system 10 can also be applied to captains chairs used in vehicles such as but not limited to motor homes to provide additional storage space. A cloth pad 60 can also be disposed over support frame 26 to provide additional wear resistance between any cushions provided for furniture member 58 and support frame 26. Cloth pads 60 are known in the art and therefore will not be discussed further herein.

Referring now to FIG. 7, in an alternate embodiment of the present invention, a furniture support system 70 is connectively mounted substantially within and to support structure 11. Furniture support system 70 includes a support frame 72 similar to first tube member 36 of support frame 26. Support frame 72 includes a pair of side tube sections 74 (only one of which is visible in this view) and a front tube cross member 76. Support frame 72 is rotatable about a pivoting joint 78 similar to pivoting joints 33. A pair of side rail brackets 80 (only one is visible in this view) are fastenably connected to each of first and second side frame members 14, 15.

Furniture support system 70 further includes a dampening device 82. According to one preferred embodiment, dampening device 82 is a fluid assisted dampening device which is rotatably connectable to one or both of side tube sections 74 using a rod connector 84. An opposite end of dampening device 82 is fastenably connected to either first or second side frame member 14, 15 at side rail brackets 80. A plurality of occupant support webs or support straps 86, similar to support straps 28, are connected between both front tube cross member 76 and a rear support member 88. Furniture support system 70 includes a modification from support system 10 with regard to the mounting of occupant support webs 86. Rear web support member 88 is directly connected or supported between each of first and second side frame members 14, 15. Additional tubing is therefore not required, reducing the number of tubing component parts for support frame 72.

In place of cross member 32, furniture support system 70 provides a rod 90 extending between first and second side frame members 14, 15. Rod 90 is positioned above each of support straps 86 in contrast to the support method provided by cross member 32. Deflection of support straps 86 for furniture support system 70 from the weight of an occupant is therefore generally downward as viewed in FIG. 7 and below the elevation of side tube sections 74. Dampening devices 82 are provided in furniture support system 70 to further assist in dampening the pivoting motion of support frame 72. Similar to furniture support system 10, front tube cross member 76 is, supported proximate to front frame member 24 using one or more support brackets 92 in the first or seating support position of support frame 72. Dampening devices 82 according the present invention can also include a cam assembly or any spring assisted device which acts to dampen the pivoting motion of the support frame.

As best seen in reference to FIG. 8, a plurality of sinuous wires 93 are each interwoven with each of the support straps 86 similar to elastomeric elements 48. A length of sinuous wires 93 is similarly limited between front tube cross member 76 and rod 90. A bend 94 transitions each of the side tube sections 74 to front tube cross member 76. Dampening device 82 is positioned substantially directly below one or both of side tube sections 74. This prevents contact between any of support straps 86 and dampening devices 82.

Referring next to FIG. 9, support frame 72 is shown in its second or rotated position following rotation about an arc "K". Side rail brackets 80 are fastenably supported to each of first and second side frame members 14, 15 using a plurality of fasteners 96. Where a fluid assisted device is used for dampening device 82, a cylinder 98 is rotatably supported using a fastener 96' to side rail brackets 80. A piston rod 100 extends outwardly from cylinder 98 when support frame 72 is in the second or raised position. The position of rod 90 with respect to support straps 86 is predetermined to prevent contact between support straps 86 and lumbar support cushion 20 when support frame 72 is raised. A spring or cam assembly can also be used to replace cylinder 98 and piston rod 100. Similar to furniture support system 10, furniture support system 70 provides generally unimpeded access to cavity 42, reduced by support brackets 92. An angle β created in the second position is similar to angle α of furniture support system 10.

As best seen in FIG. 10, a total length "L" of sinuous wires 93 is similar to total length "H" of elastomeric elements 48. Total length "L" is defined substantially between an interior facing surface of front frame member 24 and a longitudinal centerline 102 of rod 90. An axis of rotation 104 is formed through a fastener 106 for each pivoting joint 78. Fasteners 106 are similar to fourth fasteners 52 of furniture support system 10.

Figures 11, 12:
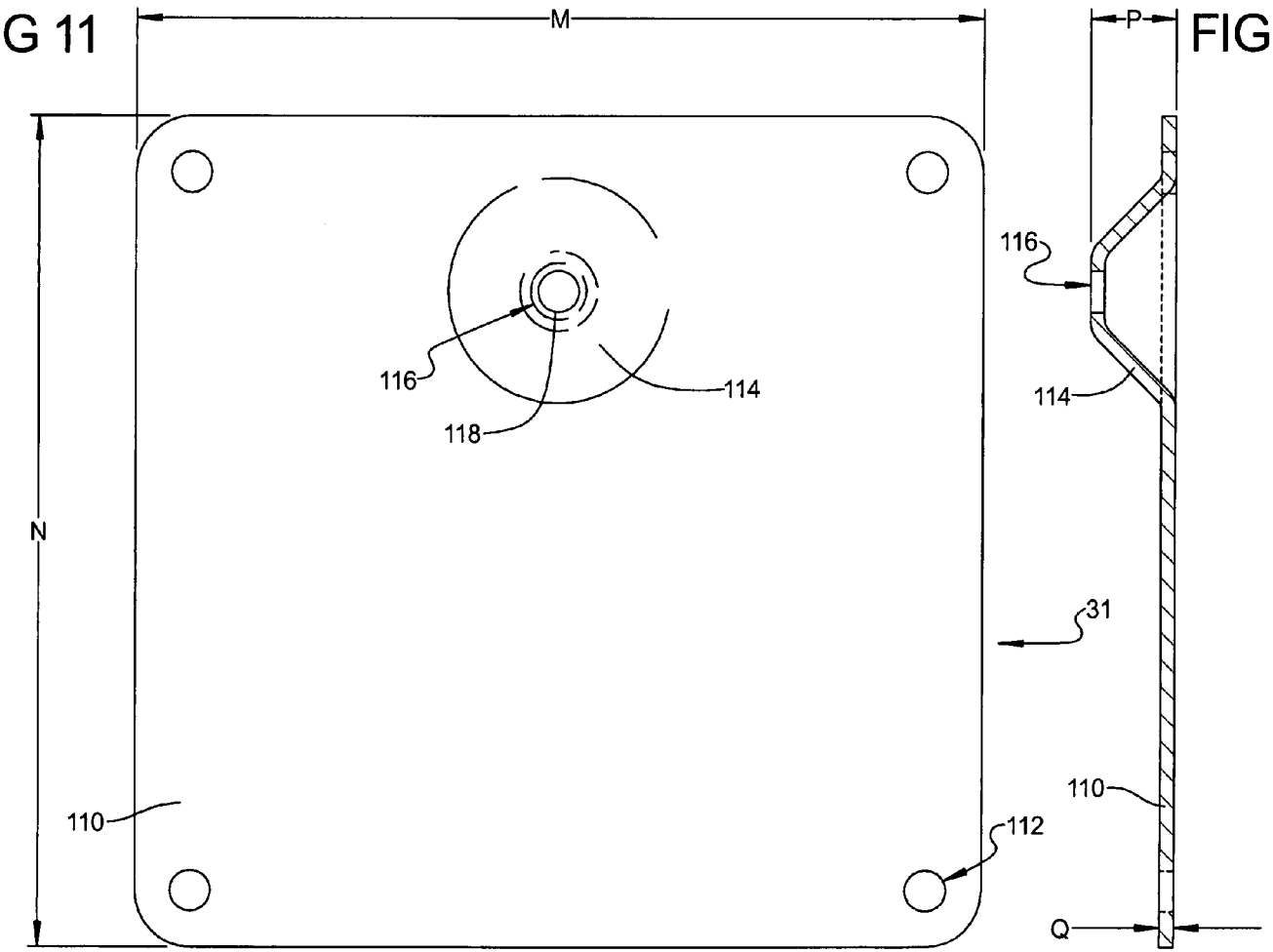
FIG. 11 is a front elevational view of a side rail bracket according to a preferred embodiment of the present invention.
FIG. 12 is an end elevational view of the side rail bracket of FIG. 11.

Referring now to FIGS. 11 and 12, side rail brackets 31 are created from a plate section 110 having a plurality of fastener clearance apertures 112 created therethrough. Plate section 110 in one preferred embodiment is substantially square, however, plate section 110 can have any generally rectangular shape and includes a width "M" and a height "N". In one preferred embodiment of the present invention, width "M" and height "N" are approximately four inches (10.1 cm). A raised embossment 114 is created in plate section 110 having an embossment height "P". An embossed stamping 116 is created proximate to a receiving aperture 118 formed through raised embossment 114. Embossed stamping 116 provides a substantially flat surface for receiving fastener 106. Plate section 110 also includes a thickness "Q" which can vary at the discretion of the designer. According to one preferred embodiment of the present invention, embossment height "P" is approximately 0.375 inches (0.95 cm). The location and embossment geometry of raised embossment 114 can vary from that shown without departing from the gist of the present invention. Dimensions "M" and "N" can also vary depending upon the dimensions of the individual furniture support structure.

Figure 13:
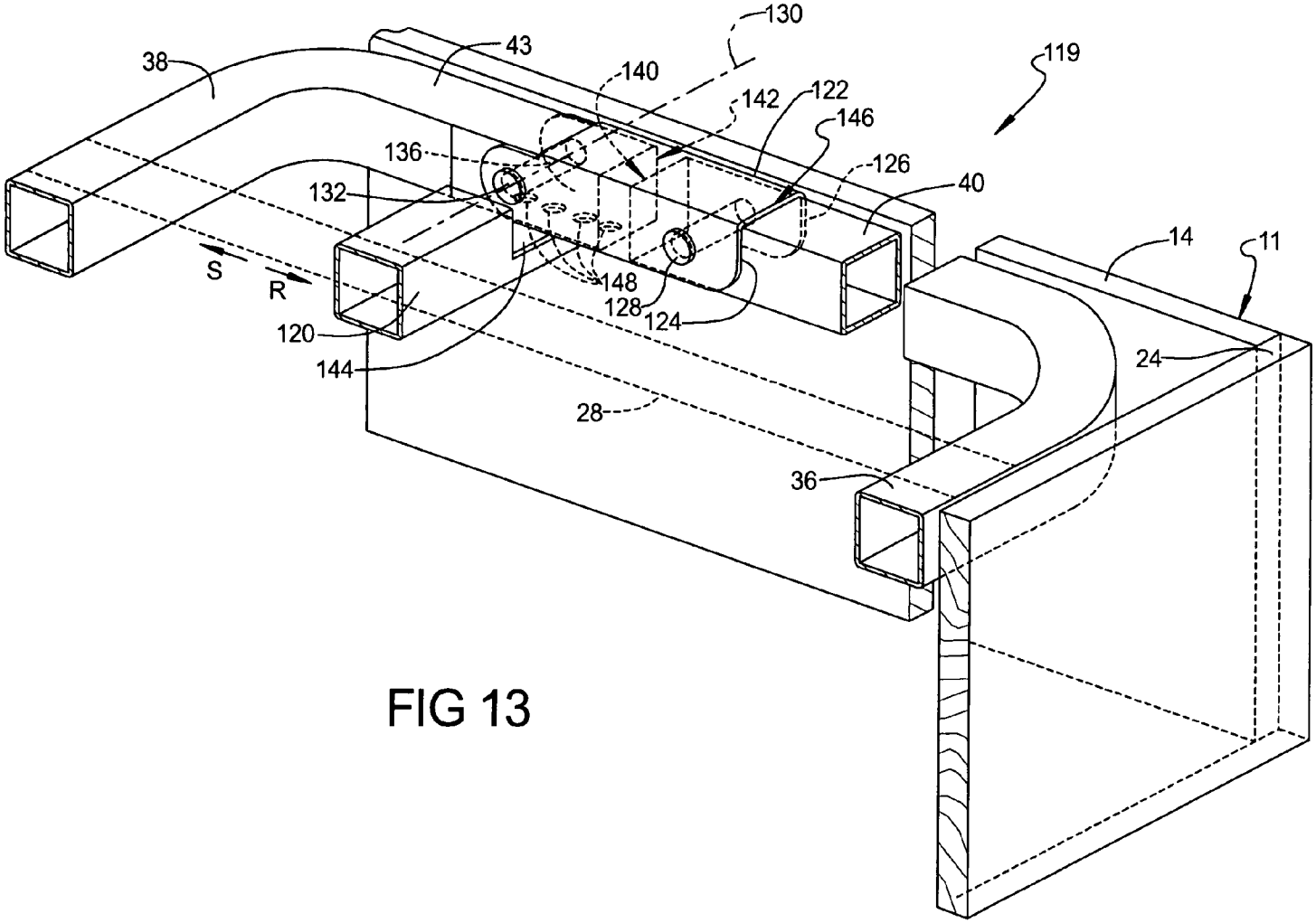
FIG. 13 is a front perspective view of an yet another embodiment of an access and support system for convertible furniture of the present invention.

Referring now generally to FIG. 13, in another embodiment a furniture support system 119 is modified from furniture support system 10. Furniture support system 119 includes first and second tube members 36, 38 connected to support structure 11. The connection device of furniture support system 119 differs from the connection device used for furniture support system 10. A cross member 120 replaces cross member 32. First and second ends 40 of first tube member 36 and opposed ends 43 of second tube member 38 are each connected to a pair of U-shaped brackets 122. Each U-shaped bracket 122 includes an inward facing first bracket wall 124 and a second bracket wall 126 positioned in parallel with and spatially separated from either first or second side frame member 14, 15. First and second ends 40, 41 of first tube member 36 are each fixedly connected to first and second bracket walls 124,126 of their respective U-shaped bracket 122 using a fastener 128.

Opposed ends 43 of second tube member 38 are fixedly supported to each of the U-shaped brackets 122 using a fastener 132. Fasteners 132, which can include rivets, also operably provide for rotation of both second tube member 36 and U-shaped brackets 122. Fasteners 132 are each disposed within an aperture 136 created through both first and second bracket walls 124, 126 of U-shaped bracket 122 and opposed ends 43 and can extend through first and second side frame members 14,15. Fasteners 132 further define an axis of rotation 130 for first tube member 36. A tube end face 140 of both first and second ends 40, 41 of first tube member 36 are each spatially separated from a tube end face 142 of each of the opposed ends 43 to provide clearance for rotation of first tube member 36 about axis of rotation 130. A spacer block similar to spacer block 47 can also be positioned between opposed ends 43 and first and second side frame members 14,15 to provide clearance for rotation of first tube member 36 and the U-shaped brackets 122. One or more additional fasteners such as first fastener 45 can be used as necessary to fix opposed ends 43.

Cross member 120 is modified from cross member 32 to delete the bends and distal ends and replace those members with an opposed pair of flattened portions 144. Flattened portions 144 abut to a lower wall 146 of each of opposed ends 43. Each flattened portion 144 includes an aperture (not visible in this view) which is aligned with one of a plurality of apertures 148 created in lower wall 146 of each of opposed ends 43. A fastener (not shown) is inserted through flattened portion 144 and through one of apertures 148 to adjustably position cross member 120. By using one of the plurality of apertures 148, cross member 120 is adjustable in either a direction "R" or an opposite direction "S". This adjustability allows the designer and/or furniture manufacturer to adjust the support provided by straps 28 (shown in phantom only for clarity). Cross member 120 otherwise provides a similar function to cross member 32 being positioned below and therefore in support of each of the plurality of support straps 28.

Figure 14:
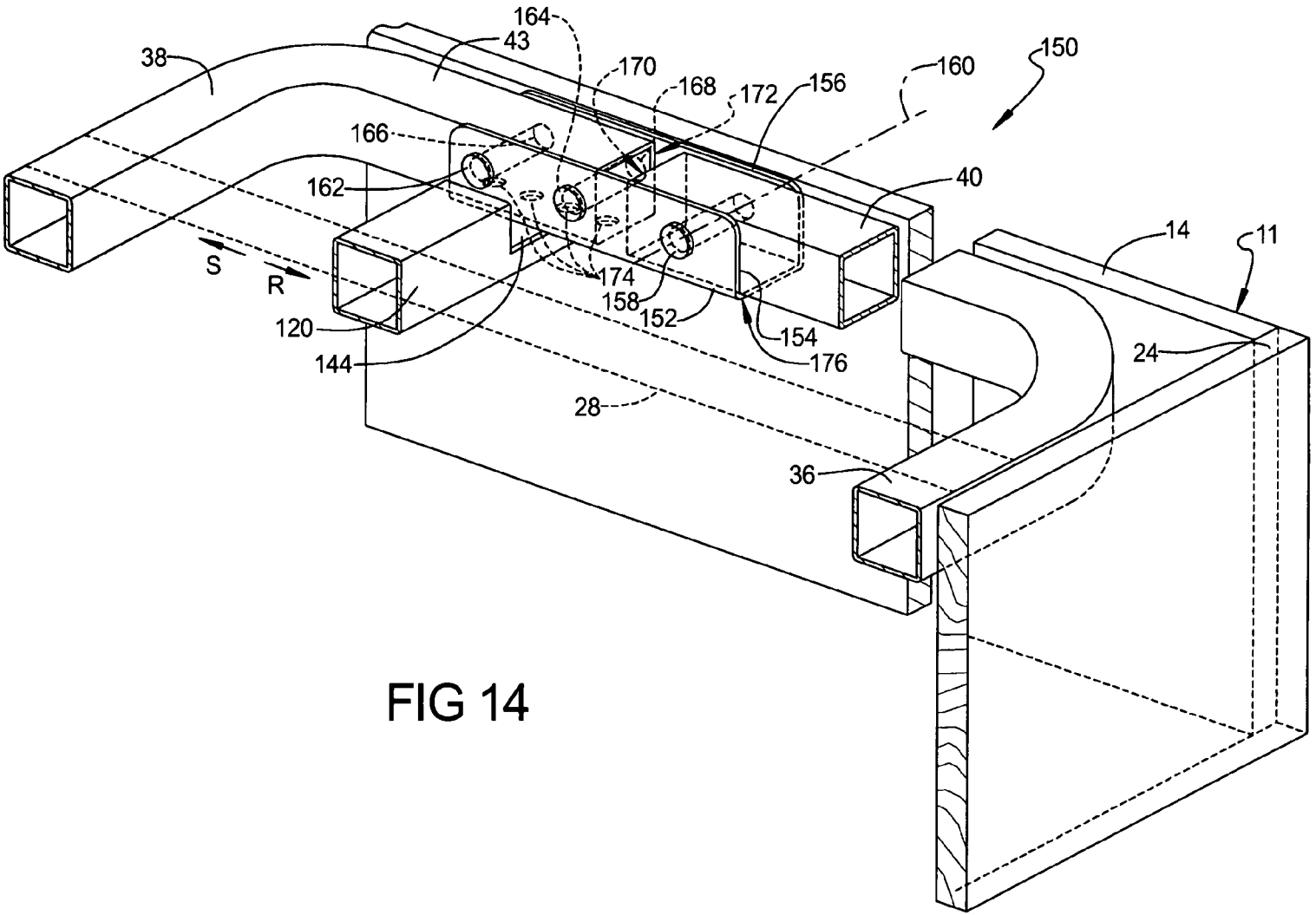
FIG. 14 is a front perspective view similar to FIG. 13, of still another embodiment of the present invention.

Referring now generally to FIG. 14, another embodiment of a furniture support system 150 is modified from furniture support system 119, therefore only the differences with be further described. Furniture support system 150 includes a pair of U-shaped brackets 152. First and second ends 40 of first tube member 36 and opposed ends 43 of second tube member 38 are each connected to one of U-shaped brackets 152. Each U-shaped bracket 152 includes an inward facing first bracket wall 154 and a second bracket wall 156 positioned in parallel with and spatially separated from either first or second side frame member 14, 15. First and second ends 40, 41 of first tube member 36 are each rotatably connected to first and second bracket walls 154,156 of their respective U-shaped bracket 152 using a fastener 158 such as a rivet. Fasteners 158 further define an axis of rotation 160 for first tube member 36.

Opposed ends 43 of second tube member 38 are fixedly supported to each of the U-shaped brackets 152 using first and second fasteners 162,164. Fasteners 162,164 are each disposed within an aperture 166,168 created through both first and second bracket walls 154, 156 of U-shaped bracket 152 and opposed ends 43, and extend through first and second side frame members 14,15. A tube end face 170 of both first and second ends 40, 41 of first tube member 36 are each spatially separated from a tube end face 172 of each of the opposed ends 43 and can be rounded to provide clearance for rotation of first tube member 36 about axis of rotation 160.

Flattened portions 144 of cross member 120 abut to a lower wall 176 of U-shaped channels 152. Each flattened portion 144 includes an aperture (not visible in this view) which is alignable with one of a plurality of apertures 174 created in lower wall 176. A fastener (not shown) is inserted through the aperture in flattened portion 144 and through one of apertures 174 to adjustably position cross member 120. Cross member 120 is thereby adjustable in either direction "R" or opposite direction "S" and is positioned below and therefore in support of each of the plurality of support straps 28.

Referring generally to FIGS. 2, 7, 13 and 14, it is further advantageous if the location (height) of pivoting joints 33 and 78 and/or of axes of rotation 130 and 160 be positioned above-center or elevated above the connection points of the support straps 28 or 86 to the first tube members 36 or front tube cross members 76, and either the second tube members 38 or rear support member 88. This feature is particularly visible in reference to FIG. 7. By elevating the pivot joints or axes of rotation, the natural spring tension created by the elastomeric elements 48 or sinuous wires 93 tends to hold the support frame in either of the first (or down/support) position or the second (or up/open) position until the user elects to reposition the support frame.

An access and support system for convertible furniture of the present invention offers several advantages. A support frame positioned below the seating area, including the seating cushions, is partially rotatable to permit access to the space below the seating area. Seating support straps are connected across spaced tubular members of the support frame. An adjustable frame member is located proximate to the support straps to provide a variable support point which allows varying the seating support stiffness. By optionally providing sinuous wire support members interwoven with the support straps, which extend for only a portion of the length of the support straps, the elasticity of the sinuous wire support members help support the frame in a rotated or open position. The reduced complexity and volume of the support frame of the present invention also permits the furniture member rear frame to be moved or curved inwardly, without interfering with the operation of the support frame.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. A furniture seating support system connectable to a furniture member support structure, the support system comprising:

first and second elements;

a cross member fixed to the support structure independent of the first and second elements and non-rotatable, and positionable between the first and second elements; and a pair of joints each operable to permit rotation of the first element with respect to the second element and the cross member; and at least one user support member connected at least to the first element and supportable by the cross member, and deflectable at least proximate to an interface with the cross member during rotation of the first element.

2. The seating support system of claim 1, further comprising:

a frame adapted to support the first and second elements and the cross member;

an opposed pair of ends of the first element;

a pair of brackets each disposed between one of the ends of the first element and the frame, each bracket adapted to connect the first element to the frame.

3. The seating support system of claim 2, wherein each bracket further comprises a raised embossment operably creating a bearing surface for one of the joints.

4. The seating support system of claim 3, further comprising a pair of rivets each disposed through one end of the first element and the raised embossment of one of the brackets, the rivets defining an axis of rotation of the joints.

5. The seating support system of claim 3, further comprising a first fastener disposed through at least one of a pair of opposed walls of the U-shaped channel and the one of the opposed pair of ends of the first element, the first fastener operable to create one of the joints.

6. The seating support system of claim 2, wherein each of the brackets comprises a U-shaped channel, one of the opposed pair of ends of the first element and one of a pair of side sections of the second element being disposed within the U-shaped channel.

7. The seating support system of claim 2, further comprising:

a pair of opposed ends of the cross member; and at least two elongated fasteners, each operable to non-rotatably connect one of the opposed ends of the cross member to the frame.

8. The seating support system of claim 7, further comprising an adjustment system wherein the opposed ends of the cross member are each adjustably positionable using the adjustment system to vary a stiffness of the support member.

9. The seating support system of claim 2, further comprising:

an opposing pair of side sections of the second element; and at least one fastener operable to fixedly connect each side section of the opposing pair of side sections to the frame.

10. The seating support system of claim 2, further comprising:

at least one dampening device having a piston rod extendable from a cylinder;

a connecting end of the piston rod connected to the first element; and a cylinder connection end connected to the frame;

wherein the dampening device is operable to dampen rotation of the first element.

11. The seating support system of claim 1, wherein the user support member further comprises an elastomeric element.

12. The seating support system of claim 11, wherein the elastomeric element comprises a sinuous wire positioned between and proximate to both the first element and the cross member.

13. The seating support system of claim 1, further comprising at least one biasing device connectable to the first element, wherein the biasing device is operable to bias the first element in each of a seating position having the first and second elements positioned substantially co-planar to each other, and a rotated position.

14. A furniture seating support system connectable to a furniture member support structure, the support system comprising:

a frame having a plurality of substantially tubular-shaped elements, the frame including:

front and rear elements configured substantially parallel to each other;

a cross member adjustably connectable to the frame and positioned between the front and rear elements; and a pair of pivot joints each rotatably connecting one of an opposed pair of ends of the front element to one of the frame and the furniture member support structure, the pivot joints operably permitting rotation of the front element;

a plurality of elastically flexible support straps each connected to both the front and rear elements and operable to support a weight of an occupant;

a pair of distal ends of the cross member; and at least two elongated fasteners, each operable to non-rotatably connect one of the distal ends of the cross member to the frame;

wherein the cross member is adjustably positionable proximate the flexible support straps using a position adjustment system to operably limit a deflection of the support straps, the cross member operable to vary a support stiffness of the flexible support straps.

15. The seating support system of claim 14, further comprising a plurality of sinuous wires each operably joined to one of the plurality of support straps.

16. The seating support system of claim 15, wherein each of the plurality of sinuous wires include a first end positioned proximate to the front element and a second end positioned proximate to the cross member.

17. The seating support system of claim 14, wherein the adjustment system further comprises a plurality of apertures created in the frame, wherein the distal ends of the cross member are each adjustably positionable by selectively locating the elongated fasteners in ones of the plurality of apertures to vary the support stiffness of the support straps.

18. The seating support system of claim 14, further comprising:

an opposing pair of side sections of the rear element; and at least one fastener operable to fixedly connect each side section of the opposing pair of side sections to at least the frame.

19. A furniture seating support system connectable to a furniture member support structure, the support system comprising:

a support structure defining a cavity;

a frame having a plurality of substantially tubular elements, the frame connectable to the support structure substantially within the cavity and occupying a first portion of the cavity, the frame including:

a first element having a tube member including first and second ends, the tube member and the first and second ends defining a U-shape;

a second element fixed to the support structure;

the first and second elements including the first and second ends configured substantially parallel to each other in a frame first seating support position;

a cross member connectable to the frame and positioned between the first and second elements, the cross member also configured substantially parallel to the first and second elements in the first seating support position; and a pair of pivoting joints each rotatably connecting one of the ends of the first element to the support structure, the pivoting joints operably permitting rotation of the first element independent of the second element and the cross member; and a plurality of elastically deflectable support straps each connected to both the first and second elements and operable to support a weight of an occupant;

wherein upon rotation of the first element from the first seating support position to a second raised position, a second portion of the cavity is accessible by a user.

20. The furniture member of claim 19, further comprising a pair of brackets each disposed between one of the ends of the first element and the support structure.

21. The furniture member of claim 20, wherein each bracket further comprises a raised embossment operably creating a bearing surface for one of the pivoting joints.

22. The furniture member of claim 20, wherein each of the brackets comprises a U-shaped channel, one of the opposed pair of ends of the first element and one of a pair of side sections of the second element being disposed within each U-shaped channel.

23. The seating support system of claim 22, further comprising a first fastener disposed through at least one of a pair of opposed walls of the U-shaped channel and the one of the opposed pair of ends of the first element, the first fastener operable to create one of the pivoting joints.

24. The furniture member of claim 19, wherein the support structure comprises a wood material.

25. The furniture member of claim 19, wherein the first and second elements further comprise a substantially rectangular shaped metal tubing.

26. The furniture member of claim 19, wherein the pivoting joints each further comprise a rivet defining a rotational axis.

27. The furniture member of claim 19, wherein the pivoting joints each further comprise a metallic fastener defining a rotational axis.

28. The furniture member of claim 19, further comprising a plurality of sinuous wires each operably joined to one of the plurality of support straps.

29. The furniture member of claim 19, further comprising:

opposed ends of the cross member; and at least two elongated fasteners, each operable to non-rotatably connect one of the opposed ends of the cross member to the frame.

30. The furniture member of claim 29, further comprising an adjustment system having a plurality of fastener clearance apertures wherein the opposed ends of the cross member are each adjustably positionable by selectively locating the elongated fasteners in ones of the plurality of fastener clearance apertures to vary a support stiffness of the support straps.

31. A method for creating a rotatable support frame for a furniture member to operably provide access to a cavity within a support structure of the furniture member, the support frame having first and second elements, a cross member, a pair of pivoting joints and a plurality of support members; the method comprising:

connecting the support frame to the support structure such that the second element and the cross member are each independently fixed to the support frame and only the first element is rotatable with respect to the support structure;

joining each of the plurality of support members to at least one of the first and second elements to operably support a weight of a user;

positioning the cross member between the first and second elements to operably control a stiffness of the support members; and rotating the first element about the pivoting joints on a rotational arc to change a tension of the support members and operably permit access to the cavity by the user.

32. The method of claim 31, further comprising coupling each of a plurality of elastomeric elements to individual ones of the support members to further control the stiffness of the support straps.

33. The method of claim 31, further comprising interweaving each of a plurality of sinuous wires with individual ones of the support members to further control the stiffness of the support straps.

34. The method of claim 33, further comprising predetermining a length of each of the sinuous wires.

35. The method of claim 33, further comprising positioning each of the sinuous wires only between the first element and the cross member.

36. The method of claim 31, further comprising connecting the first element to the support structure using the pair of pivoting joints.

37. The method of claim 31, further comprising repositioning the first element between a first seating support position and a second raised position during the rotating step, wherein the cavity is accessible in the second raised position.

38. The method of claim 31, further comprising dampening a rotation of the first element with a dampening device.

39. The method of claim 31, further comprising inserting a fastener through one of a plurality of apertures of the frame during the positioning step.

40. The method of claim 31, further comprising non-rotatably positioning the cross member.

41. A furniture seating support system connectable to a furniture member, the support system comprising:

first and second elements spatially separable from each other, the first element further including opposed and perpendicularly oriented first and second side members;

a member positionable between the first and second elements, the first and second elements and the member being oriented substantially co-planar to each other in a first element seating position; and at least one rotatable joint operable to permit the first element to rotate independent of the second element and the member, about an arc between each of the first element seating position and a first element raised position.

42. The seating support system of claim 41, wherein the at least one rotatable joint comprises a pair of rotatable joints each connected to one of the first and second side members.

43. The seating support system of claim 42, wherein each joint of the pair of rotatable joints is further connected to a frame member non-rotatable with respect to the first element.

* * * * *